United States Patent [19]

McCoy

[11] Patent Number: 5,009,467

[45] Date of Patent: Apr. 23, 1991

[54] ADJUSTABLE ARMREST FOR CHAIR

[76] Inventor: David C. McCoy, 1903 Brooks La., Oviedo, Fla. 32765

[21] Appl. No.: 358,814

[22] Filed: May 30, 1989

[51] Int. Cl.[5] ..... A47C 7/54

[52] U.S. Cl. ..... 297/411; 297/415

[58] Field of Search ..... 297/418, 414, 415, 422, 297/464, 391, 411; 248/118

[56] References Cited

U.S. PATENT DOCUMENTS

| | | | |
|---|---|---|---|
| 455,168 | 6/1891 | Case | 297/314 |
| 1,527,754 | 2/1925 | Simon | 297/411 X |
| 1,731,709 | 10/1929 | Cropsey | 297/411 X |
| 3,148,914 | 9/1964 | Steely | 297/464 X |
| 4,025,112 | 5/1977 | Hale | 297/411 |
| 4,277,102 | 7/1981 | Aaras et al. | 297/411 |
| 4,466,665 | 8/1984 | Aronowitz | 297/418 |

FOREIGN PATENT DOCUMENTS

| | | | |
|---|---|---|---|
| 1029138 | 4/1958 | Fed. Rep. of Germany | 297/411 |
| 2558360 | 7/1985 | France . | |
| 919739 | 2/1963 | United Kingdom | 297/418 |
| 1481185 | 7/1977 | United Kingdom . | |

OTHER PUBLICATIONS

J. Travell & D. Simons, Myofascial Pain and Dysfunction: The Trigger Point Manual, Williams & Wilkins, 184–185 & 196–197.

Inmac Catalog, TS 0980, Santa Clara, Calif., 48–49.

*Primary Examiner*—Peter R. Brown

*Attorney, Agent, or Firm*—Warren L. Franz

[57] ABSTRACT

An adjustable armrest attachment for a secretarial chair has left and right elbow rests with depending posts independently selectively positionable within vertical channels formed in turned back outer ends of respective left and right, oppositely laterally extending bracket members. Superposed inner ends of the bracket members are attached to the chair by fasteners which pass through lateral slots to permit opposite lateral movement of the members to selectively vary the lateral spacing of the rests. In one embodiment the inner ends are attached by a bracket plate to a column that elevates a backrest at the rear of a seat. In another embodiment, the inner ends are attached by a knurled, manually manipulable knob to the underside of the seat. The rests are located to give the reduce antigravity stresses when the chair is pulled under a desk or table for raised hand operations, like typing.

6 Claims, 1 Drawing Sheet

ADJUSTABLE ARMREST FOR CHAIR

This invention relates to a secretarial or similar chair having adjustable armrests and to an attachment for retrofitting such a chair to provide such armrests.

BACKGROUND OF THE INVENTION

A person with average length upper arms seated in a properly designed straight back chair having armrests will have elbows well supported. However, a person with short upper arms or one seated in an improperly designed chair may experience a strained posture. Improperly supported elbows or elbows that dangle because of no support whatsoever, such as with armless secretarial-type chairs and the like, will experience overloading of the upper trapezius muscles. Sustained antigravity stresses (also called "gravity stresses") imposed on the trapezius muscles may refer pain upward along the posterolateral aspect of the neck to the mastoid process, and are a major source of what is known as "tension nechache." See, J. Travell & D. Simons, *Myofascial Pain and Dysfunction: The Trigger Point Manual*, Williams & Wilkins, at 184–85 and 196–97. The latter reference recognizes that antigravity stresses on the upper trapezius in normally proportioned individuals can be avoided by using chairs with armrests of the correct height to provide proper elbow support. Disturbances caused by antigravity stresses are especially troublesome for persons such as secretaries, typists, stenographers, draftsmen, medical technicians, and the like whose seating arrangements provide little, if any, elbow support. The usual chair used by such persons (hereafter "secretarial chair") has a generally horizontally disposed seat whose underside is centrally supported on an upwardly directed pillar base. The lower end of the base is typically accommodated with a plurality of radially outwardly directed, spoke-like legs which carry swivel-mounted casters at their ends. A generally vertically disposed backrest is supported on one or more columns extending vertically, generally centrally up at the back of the seat. The pillar base may be telescoping or provided with other means to permit selective height adjustment of the seat above the floor. In many cases, the backrest column support is likewise constructed to permit independent height adjustment of the backrest relative to the seat. The majority of secretarial chairs are, however, armless so that they present no obstruction when drawn closely into a table. Those which do have arms, have arms that are either fixed or else not conveniently adjustable relative to other parts of the chair to permit proper positioning to support arms when drawn in to a table or desk for performing raised hand mechanical operations, such as typing.

Aronowitz U.S. Pat. No. 4,466,665 shows a secretarial chair for office use which has integrally molded arm and lower back sections adapted to provide lumbar support to a person sitting in the chair. The height of the arm/backrest combination is adjustable relative to the seat by selective positioning vertically along a strap column. No provision is made for adjustment of the arm section relative to the backrest section, nor to vary the lateral spacing of one armrest relative to the other.

British Patent Specification No. 1,481,185 shows a chair having left and right armrests carried on vertically extending upper ends of left and right bent rod carrier posts whose lower ends extend laterally inward to connect rigidly to opposite points on the underside of the seat. A downward opening, vertical recess within each armrest acts with the carrier post to provide a lockable telescopic connection by which the armrest can be slidably height adjusted relative to the seat, independently of positioning of the backrest. The same connection permits pivoting of the armrest to establish a desired angular orientation of the vertical plane of the armrest about the axis of the rod upper end. There is, however, no provision made for adjustment of the lateral spacing of one armrest rod attachment point relative to the other, and the rests are full length rests that, if kept in an arm supporting position, would interfere with bringing the seat under a desk or table.

French Patent Publication No. 2,558,360 discloses armrests mounted at the forwardly directed ends of a generally horizontal, crescent-shaped bracket on a secretarial-type chair for independent slidable height adjustment on the same column which carries a lumbar supporting backrest. The underside of the armrests are provided with transverse slots that enable selective adjustment of the lateral spacing of the arms relative to one another, but only within the limitations of the width dimensions of the armrests. No provision is made for relative adjustment of the height of one armrest relative to the other.

Aaras et al. U.S. Pat. No. 4,277,102 discloses a chair for employees doing routine factory jobs that has armrests mounted on support posts and the posts mounted to the seat body by means of universal joints. Despite the great freedom of movement, though, positional adjustment of the armrests in such an arrangement is made awkward because of the arcuate nature of the pivotal movements which hinders making horizontal adjustment while vertical adjustment is maintained, and vice versa. Moreover, the support posts do not provide armrest support without obstructing the ability to draw the chair up to a desk for typing, etc.

SUMMARY OF THE INVENTION

It is an object of the present invention to provide a secretarial chair, or the like, having an improved armrest assembly including means for independent adjustment of the height of left and right armrests, and of the lateral spacing between those rests, which can give suitable elbow support to a chair occupant even when the chair is drawn closely in to a desk or table, such as for typing.

It is a further object of the present invention to provide an armrest attachment having such independently adjustable means for retrofitting an existing conventional secretarial or similar chair to give elbow support to a user.

In accordance with the invention, a chair having a generally horizontal seat supported in elevated position on a pillar base and a generally vertical backrest supported rearward of the seat on a column is provided with an adjustable armrest assembly having left and right elbow rests attached in opposing, left and right, laterally spaced positions at the outer ends of laterally extending bracket members. The inner ends of the members are attached in adjacent positions to the chair. Means are located at the inner ends of the brackets for selectively varying the lateral spacing of the elbow rests while maintaining their vertical positioning, and means are located at the outer ends of the brackets for selectively varying the elevation above the seat of each rest individually.

In one embodiment of the invention, described in detail below, the brackets are generally horizontally disposed, each having a laterally outwardly extending inner portion and a forwardly extending outer portion, with the inner ends of the brackets attached by means of a slotted plate to the column supporting the backrest above the seat. Fasteners passing through the plate and through aligned, laterally extending, elongated slots on superposed parts of the inner ends releasably clamp the column to hold the brackets to the chair and permit selective opposite lateral sliding movement of the brackets to set the spacing between the rests. The outer ends of the brackets are directed back on themselves to form channels into which posts depending from the rests are slidingly received to be releasably clamped at selected positions therein which set the elevation of the rests above the seat.

In another embodiment, also described below, the brackets have generally horizontal, laterally extending inner portions and generally vertical, upwardly extending outer portions, and their inner ends are attached to the underside of the seat.

BRIEF DESCRIPTION OF THE DRAWINGS

Embodiments of the invention have been chosen for purposes of illustration and description, and are shown in the accompanying drawings, wherein.

Throughout the drawings, like elements are referred to by like numerals.

DESCRIPTION OF THE PREFERRED EMBODIMENTS

Figure 1:
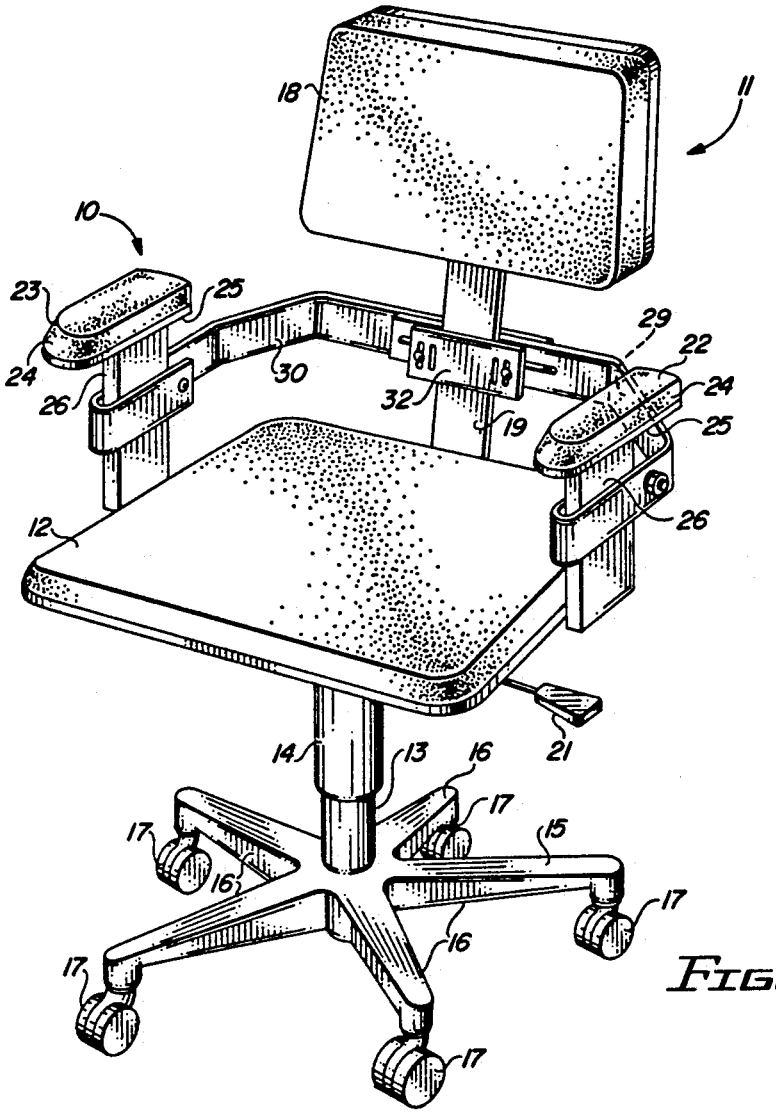
FIG. 1 is a front perspective view of an adjustable armrest attachment in accordance with the invention shown in combination with a conventional secretarial chair.

The principles of the invention are illustrated, by way of example, embodied in the form of an adjustable armrest attachment 10, shown in combination with a conventional secretarial chair 11. The chair 11 comprises a generally horizontal seat 12 supported in elevated position above the floor by a base 13 which has a height adjustable, telescoping tubular pillar portion 14 extending vertically and centrally up from a lower end 15 comprising a spoke-like arrangement of angularly spaced, radially outwardly directed legs 16 whose outer ends carry double roller, swivel caster assemblies 17. The chair 11 also includes a generally vertical backrest 18 centrally supported in elevated position at the rear of the seat 12 by means of a vertically extending column 19. Extension of the pillar 14 and, thus, height adjustment of the seat 12 may be selectively controlled by a pneumatic lift locked by a lever 21 or by a similar known mechanism. A conventional releasable locking mechanism may also be provided for selectively varying the height of the backrest 18 relative to the seat 12.

Figure 2:
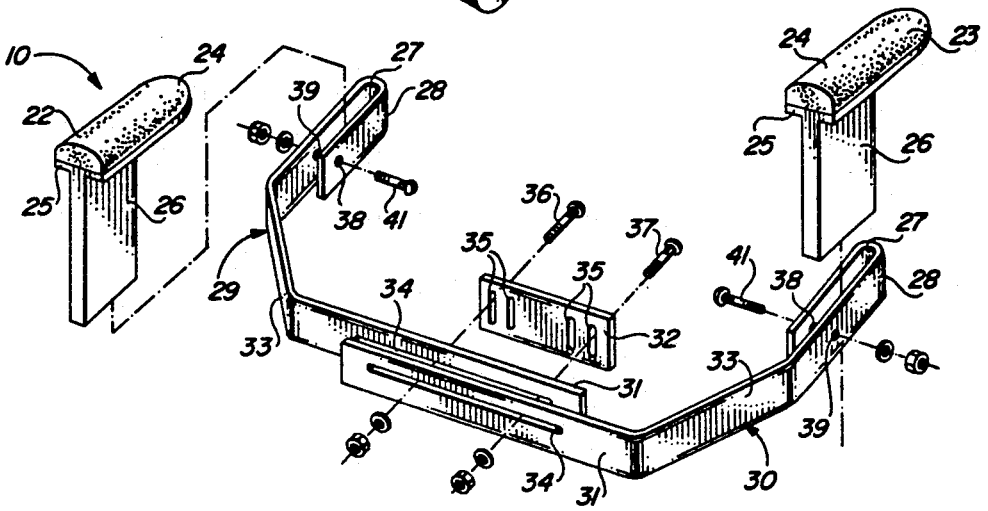
FIG. 2 is an exploded, enlarged rear view of the attachment of FIG. 1.

In accordance with an embodiment of the invention shown in FIGS. 1 and 2, the attachment 10 has left and right elbow rests 22, 23, located in independently selectable, elevated positions respectively left and right of the seat 12 to give support to the left and right elbows of a person seated in the chair with the chair drawn closely in to a desk or table for performing raised hand mechanical operations, such as typing. As shown, each rest 22, 23 has a generally horizontally disposed, forwardly projecting elongated padded upper portion 24 superposed above a similarly configured rigid base portion 25. From the underside of each base portion 25 depends a rectangular vertical post 26 whose lower end is slidably received within a vertically oriented channel 27 formed at a respective outer end 28 (see FIG. 2) of left and right, oppositely laterally extending bracket members 29, 30. Inner ends 31 of the members 29, 30 are attached in superposed relationship by means of a bracket plate 32 to the column 19 between the seat 12 and the backrest 18.

The bracket members 29, 30 shown in FIGS. 1 and 2 are generally horizontally disposed members, with the inner ends 31 extending laterally outwardly, the outer ends 28 extending forwardly, and intermediate portions 33 extending diagonally. The inner ends 31 have laterally extending elongated slots 34. The plate 32 is formed with a plurality of vertically extending elongated slots 35. The inner ends 31 are placed in adjacent, superposed positions against the column with their respective slots 34 in axially parallel alignment. The plate 32 is placed diagonally opposite against the column 19 with a slot 35 to the left and a slot 35 to the right of the column 19. Fasteners 36, 37 are then passed through the bracket slots 34 and the left and right plate slots 35 and tightened to clamp the column 19 between the inner ends 31 and the plate 32, to releasably lock the inner ends 31 in fixed positions relative to the column 19. When the fasteners 36, 37 are loosened, the slots 34 permit the inner ends 31 of the bracket members 29, 30 to be moved laterally opposite to each other within a horizontal plane, in order to selectively vary the lateral spacing of the outer ends 28 and, thus, the lateral spacing of the elbow rests 22, 23 relative to the seat, as desired by the user. Locating the means for varying the lateral spacing of the elbow rests 22, 23 at the inner end point of attachment of the bracket members 29, 30 to the chair 11, rather than at the outer end point of attachment of the rests 22, 23 to the members 29, 30, provides for greater freedom of lateral adjustment without restriction due to the lateral dimensions of the rests themselves.

The channels 27 are defined, as shown, by portions of the outer ends 28 that turn back on themselves. The front-to-rear parallel runs of the turned back portions have oppositely located apertures 38, 39 through which fasteners 41 are passed to releasably lock the posts 26 at user selected positions within the respective channels 27. When the fasteners 41 are loosened, the position of each rest 22, 23 can be varied within its respective vertical plane, as desired, without changing its horizontal positioning. For the post-in-channel arrangement shown, the elevation of each rest is varied independently, so that the two rests can be set at different elevations relative to the seat 12, if desired.

It will be appreciated that the adjustable armrest in accordance with the invention can be provided as a part of the original equipment at the time of manufacture of the chair or can be retrofitted as aftermarket equipment to an already existing chair by the end user. The positioning of the posts and brackets rearward of the front of the seat and the relative positioning and dimensioning of the rests is preferably arranged so that the rests serve to provide support to counteract antigravity stresses of the user when the chair is drawn up closely to a desk or a raised hand operations, such as typing.

Those skilled in the art to which the invention relates will appreciate that various other substitutions and modifications may be made to the described embodiments, without departing from the spirit and scope of the invention as defined by the claims below.

What is claimed is:

1. An adjustable armrest attachment for providing elbow support to a secretarial chair, or the like, said chair having a generally horizontal seat supported in elevated position on a base and a generally vertical backrest supported above said seat, said attachment comprising:

left and right, oppositely laterally extending bracket members having inner and outer ends;

means attaching said inner ends of said bracket member in adjacent positions at a point of attachment to said chair;

left and right elbow rests;

means respectively attaching said elbow rests to said outer ends in opposing, left and right, laterally spaced positions elevated above said seat;

means located at said inner end point of attachment for moving said inner ends laterally, opposite to each other and relative to said point of attachment, for selectively varying the lateral spacing of said elbow rests;

means releasably locking said inner ends against said opposite lateral movement; and means located at said outer ends for selectively varying the elevation of said elbow rests relative to said seat;

wherein said means for varying the lateral spacing further comprises said inner ends being placed in superposed relationship at said point of attachment and each having a laterally extending elongated slot, and said means attaching said inner ends to said chair comprises fastening means extending through said slots.

2. An adjustable armrest attachment for providing elbow support to a secretarial chair, or the like, said chair having a generally horizontal seat supported in elevated position on a base and a generally vertical backrest supported above said seat by a vertically extending support member, said attachment comprising:

left and right, oppositely laterally extending bracket members having inner and outer ends;

means attaching said inner ends of said bracket member in adjacent positions at a point of attachment to said support member;

left and right elbow rests;

means respectively attaching said elbow rests to said outer ends in opposing, left and right, laterally spaced positions elevated above said seat;

means located at said inner end point of attachment for moving said inner ends laterally, opposite to each other and relative to said point of attachment, for selectively varying the lateral spacing of said elbow rests;

means releasably locking said inner ends against said opposite lateral movement; and means located at said outer ends for selectively varying the elevation of said elbow rests relative to said seat;

wherein said means for varying the lateral spacing comprises said inner ends being placed in superposed relationship at said point of attachment and each having a laterally extending elongated slot for varying the lateral spacing while maintaining constant elevation of said elbow rests; and said means for varying the elevation comprises means for selectively varying the elevation of each of said elbow rests individually relative to said seat while maintaining constant lateral spacing between said rests;

wherein said outer ends are formed with channels, said attachment further comprises posts depending from said elbow rests and having lower ends received for vertical movement within said channels, and said means for varying the elevation of said elbow rests comprises means for releasably locking said lower ends of said posts against said vertical movement; and wherein said means attaching said inner ends to said support member comprises a bracket plate having vertically extending elongated slots, and fastening means extending through said laterally extending slots and through said vertically extending slots.

3. A secretarial chair, or the like, comprising:

a base having a pillar portion extending vertically and centrally up from a spoke-like arrangement of angularly spaced, radially outwardly directed legs;

a generally horizontal seat having a rear and being supported in elevated position on said base;

a column extending centrally upwardly at said rear of said seat;

a generally vertical backrest supported on said column; and an adjustable armrest assembly attached to said column, said assembly including:

left and right, oppositely laterally extending bracket members having inner and outer ends;

means attaching said inner ends of said bracket members in adjacent positions at a point of attachment to said column;

left and right elbow rests;

means respectively attaching said elbow rests to said outer ends in opposing, left and right, laterally spaced positions elevated above said seat;

means located at said inner end point of attachment for selectively varying the lateral spacing of said elbow rests while maintaining constant elevation of said elbow rests; and means located at said outer ends for selectively varying the elevation of each said elbow rests individually relative to said seat while maintaining constant lateral spacing between said elbow rests;

wherein said means for varying the lateral spacing comprises said inner ends being attached to said column in superposed relationship for opposite horizontal sliding movement relative to each other within a horizontal plane and each having a horizontally extending elongated slot, and said means attaching said inner ends to said column comprises fastening means extending through said slots for releasably locking said inner ends against said opposite sliding movement.

4. A chair as in claim 3, wherein said outer ends are configured to form vertically oriented channels, and said attachment further includes vertical posts depending vertically from said elbow rests and having lower ends received for sliding movement vertically within said channels, and said means for varying the elevation of said elbow rests comprises means for releasably locking said lower ends of said posts against said sliding movement.

5. An chair as in claim 4, wherein said means attaching said inner ends to said column further comprises a bracket plate having vertically extending elongated slots located left and right of said column, and said fastening means extending through said horizontally extending slots also extends through said vertically extending slots and comprises left and right fasteners respectively passing through said left and right located slots and through said horizontally extending slots for releasably clamping said column between said bracket plate and said inner ends.

6. A chair as in claim 5, wherein each of said bracket members is a generally horizontally disposed member, with said inner end extending laterally outwardly, said outer end extending forwardly, and an intermediate portion extending diagonally between said inner and outer ends.

* * * * *